United States Patent [19]

Siklosi

[11] Patent Number: 4,615,821

[45] Date of Patent: Oct. 7, 1986

[54] BENZYL ALCOHOL FOR IMPROVED POWDERED CLEANSERS

[75] Inventor: Michael P. Siklosi, Cincinnati, Ohio

[73] Assignee: The Procter & Gamble Company, Cincinnati, Ohio

[21] Appl. No.: 654,334

[22] Filed: Sep. 25, 1984

[51] Int. Cl.[4] ..... C11D 15/00

[52] U.S. Cl. ..... 252/174.25; 252/135; 252/179; 252/539; 252/540; 252/558; 252/559

[58] Field of Search ..... 252/118, 111, 112, 114, 252/115, 116, 119, 122, 123, 128, 139, 153, 154, 174.25, 539, 540, 558, 559

[56] References Cited

U.S. PATENT DOCUMENTS

| | | | |
|---|---|---|---|
| 2,739,129 | 3/1956 | Manchot | 252/174.14 |
| 3,957,695 | 5/1976 | Davies et al. | 252/174.14 |
| 4,414,128 | 11/1983 | Goffinet | 252/111 |

*Primary Examiner*—Paul Lieberman
*Assistant Examiner*—John F. McNally
*Attorney, Agent, or Firm*—Leonard Williamson; Ronald L. Hemingway; Richard C. Witte

[57] ABSTRACT

An improved powdered abrasive cleanser comprising:

(a) 0.1% to 6% of a surfactant;

(b) 0.5% to 40% benzyl alcohol;

(c) 20% to 95% of a water-insoluble abrasive material having particle diameters ranging from about 0.3 to about 0.001 millimeters; and (d) 1% to 50% detergency builder.

13 Claims, No Drawings

BENZYL ALCOHOL FOR IMPROVED POWDERED CLEANSERS

TECHNICAL FIELD

This invention relates to powdered cleansers comprising synthetic surfactants and abrasives plus an organic solvent.

BACKGROUND

Powdered abrasive cleansers have long been known to be useful for scouring porcelain sinks and fixtures, hard metallic materials, pots and pans, and similar surfaces which require high levels of mechanical abrasive for cleaning. The formulation of such powdered abrasive cleansers is discussed in great detail in U.S. Pat. Nos. 3,583,922, McClain et al., June 8, 1971; 3,829,385, Abbott, Jr., et al. Aug. 13, 1974; and 3,715,314, Morganstern, Feb. 6, 1973. U.S. Pat. No. 4,287,080, Siklosi, Sept. 1, 1981, assigned to The Procter & Gamble Company, discloses a powdered cleanser composed of tertiary alcohol, surfactant, abrasive, builder and bleach. This latter patent does not disclose benzyl alcohol. The foregoing patents are hereby incorporated herein by reference.

Liquid detergent compositions comprising benzyl alcohol are known, U.S. Pat. No. 4,414,128, Goffinet, Nov. 8, 1983. Liquid cleansers comprising benzyl alcohol, surfactant, builder, and mild abrasives are known. The prior art, however, fails to teach or recognize the advantage of benzyl alcohol in a powdered abrasive cleanser formulation; particularly in compositions containing bleach.

SUMMARY OF THE INVENTION

A powdered abrasive cleanser comprising:

(a) 0.1% to 6% of a surfactant;

(b) 0.5% to 40% benzyl alcohol;

(c) 20% to 95% of a water-insoluble abrasive material having particle diameters ranging from about 0.3 to about 0.001 millimeters (10,000 Å); and (d) 1% to 50% detergency builder.

DETAILED DESCRIPTION OF THE INVENTION

The improved abrasive cleansers described herein contain from 0.5% to 40% benzyl alcohol, preferably 3% to 12% of the cleanser composition. In the context of abrasive cleansers, benzyl alcohol is a superior solvent which is distinguished because it has surprisingly better cleaning properties than other solvents including tertiary alcohols. Benzyl alcohol also has a pleasing odor and low volatility.

In the cleansers of the present invention, the benzyl alcohol when used at levels above 3% or higher is preferably absorbed on a suitable carrier to insure a free-flowing product. The ratio of benzyl alcohol to carrier is 0.5% to 10:1. Examples of suitable carrier are fumed silicas and zeolites. A preferred carrier is Syloid silica, supplied by W. R. Grace, Inc.

Alternatively, when used at levels above 3% the benzyl alcohol can be microencapsulated to insure a free-flowing product. Microencapsulated benzyl alcohol can be obtained from a number of custom suppliers such as the 3M Co., St. Paul, Minn., and Djinnii Industries, Inc., Dayton, Ohio. Benzyl alcohol can be microencapsulated in melamine formaldehyde polymers, urea formaldehyde polymers and a number of other materials known in the art. The preferred ratio of benzyl alcohol to microencapsulation material is 10:1, but can vary from 5:1 to 20:1 on a weight basis.

The term "carrier" for benzyl alcohol, as used herein, includes absorbents and adsorbents, as well as the microencapsulating materials which encapsulate the benzyl alcohol. At levels of 0.5% to 3% benzyl alcohol, the water-insoluble abrasive, e.g., calcium carbonate, can serve as a suitable carrier for the benzyl alcohol.

The cleansers of the present invention show surprising improvement in cleaning performance, which improvement increases with an increased level of benzyl alcohol particularly in compositions which comprise from 3% to 12% benzyl alcohol. The cleaning performance increased 2.3 to 10 times over the base cleanser composition as measured by the method described in the Examples herein.

The improved abrasive cleansers described herein contain from about 0.1% to 6% of a suitable surfactant. The water-soluble organic detergents which can be used in the detergent compositions of this invention are the anionic, nonionic, zwitterionic and cationic organic detergents. Some examples of such wellknown surfactants are disclosed in U.S. Pat. Nos. 3,583,922; 3,829,385; 3,715,314; and 4,287,080, supra. The foregoing patents are hereby incorporated herein by reference.

Particularly preferred detergent compounds for use in the present powdered abrasive cleansers are the non-soap anionic detergents, particularly the alkyl benzene sulfonate detergents wherein the alkyl group has from 8 to 18 carbon atoms. Suitable examples are sodium decyl benzene sulfonate, sodium dodecyl and pentadecyl sulfonates wherein the dodecyl and pentadecyl groups are derived from a propylene polymer, and sodium octadecyl benzene sulfonates. Other preferred anionic detergents are the surface active sulfated or sulfonated aliphatic compounds, preferably having 8 to 22 carbon atoms. Examples thereof are the long chain pure or mixed higher alkyl sulfates, e.g., lauryl sulfates and coconut fatty alcohol sulfates and the $C_{12}$–$C_{18}$ paraffin sulfonates. The anionic detergent components are commonly used in the form of their water-soluble salts. Preferred water-soluble cations are the alkali metal and ammonium cations, the sodium and potassium cations being particularly preferred.

The powdered abrasive cleansers of the present invention contain from about 20% to about 95%, preferably from about 60% to about 90% of a water-insoluble abrasive material. The preferred abrasive materials for use herein are silica, calcium carbonate, and feldspar. The abrasive particles should have a diameter of from about 0.3 millimeters to about 0.001 millimeters or finer. Other abrasive materials are disclosed by example in U.S. Pat. Nos. 3,583,922; 3,829,385; 3,715,314; and 4,287,080, supra. The foregoing patents are hereby incorporated herein by reference.

The powdered abrasive cleansers of the present invention contain from 1% to 50%, preferably 5% to 20%, detergency builder. Thus, detergency builders are employed for enhanced cleaning effects. They enhance the detergency effect of the organic detergent component, and the benzyl alcohol by sequestration or precipitation of hardness ions and/or by providing alkalinity. Suitable detergency builders include highly alkaline materials such as sodium sesquicarbonate, trisodium phosphate, sodium pyrophosphate, sodium tripolyphosphate, sodium dibasic phosphate, and sodium hexametaphosphate, sodium silicates having a silicon dioxide to disodium oxide ratio of 1:1 to 3.2:1, sodium carbonate, and borax. Other detergency builders include organic materials such as sodium citrate and trisodium nitrilotriacetate. Mixtures of two or more inorganic or organic can be employed. Other examples of suitable detergency builders include those described in U.S. Pat. No. 3,309,319, at Col.4, line 44 through Col. 5, line 9. The disclosure of this patent is hereby incorporated herein by reference.

The cleanser compositions of the present invention contain from about 0.5% to, depending on the detergency builder used, about 10% moisture, preferably less than 5%.

The improved abrasive cleansers of this invention can contain an oxidizing agent for bleaching.

The common oxidizing materials used with abrasive cleansers are present such that the bleach active is at a level of 0.1% to 5%. Examples are potassium and sodium dichloroisocyanurates and chlorinated trisodium phosphate. Other oxidizing bleaches for use in the solid abrasive cleansers of the present invention are disclosed in U.S. Pat. Nos. 3,583,922; 3,829,385; 3,715,314; and 4,287,080, supra. The foregoing patents are hereby incorporated herein by reference.

Other ingredients which can also be present in the powdered abrasive cleansers of the present invention include inorganic salts such as sodium chloride, sodium sulfate, potassium chloride, and potassium sulfate, these being included in the composition in amounts less than about 20% by weight of the composition. Sodium acetate may be added to the composition as a stabilizing compound for the oxidizing bleach, at a level of 2–10 times the amount of free or loosely bound moisture which is encountered in the compositions during processing or as a result of humidity. Other minor ingredients which can be included are anticaking agents such as hydrated magnesium trisilicate or sodium carboxymethyl cellulose, sulfamic acid, perfume, antiseptics, germicides, aluminium mark removing agents such as calcium oxide or hydroxide, coloring agents, and the like.

EXAMPLE

Preparation of Simulated Bathtub Soil

Into 270 grams of isopropyl alcohol is placed 30 grams of the calcium salt of stearic acid. The mixture is stirred (in a blender) and 0.2 grams of finely divided charcoal is added. The material is stirred until the charcoal is well blended. The calcium stearate solution is placed in a Pre-Val sprayer. The soil is sprayed onto smooth, 3 inch×13 inch porcelain plates in a fume hood. The plates are laid lengthwise inclined at a slight (15°) angle. An even flow of soil is established. The sprayer is held 18 inches from the plate, while spraying across the plates four times (counting left to right and back as one). The plates are baked at 180° C. for 20 minutes. After cooling, the plates are ready for use in cleaning tests.

Cleaning of Simulated Bathtub Soil

A Gardner Model M-105-A Washability and Abrasion Machine, made by Gardner Laboratories, Inc., Bethesda, Md., a device for mechanically passing a sponge across a flat surface in a uniform and reproducible manner, is used for soil removal testing. A sponge is moistened with water to a weight of 35 grams and 1.0 gram of product is added; a weight (1300 g) is added to the sponge carriage.

The porcelain plates are cleaned with each product being tested to about 99% clean by visual observation. The strokes needed to reach this level of cleaning are recorded. The number of strokes needed are entered into the following formula: (The nonsolvent-containing cleanser is always rated a 10.)

$$\text{Scale Rating} = \frac{1}{\text{number strokes for test product}} \times 10 \times \text{number strokes for nonsolvent-containing cleanser}$$

A powdered abrasive cleanser of this invention (Composition C) is prepared by mixing 2 parts of Composition A with 8 parts of Composition B in a 50 lb. can mixer for 1 hour.

| Component | Wt. % |
|---|---|
| Composition A | |
| Benzyl Alcohol | 50 |
| Syloid Silica 244FP* | 50 |
| Composition B | |
| Calcium Carbonate (0.1 - 200μ particle size) | 70.0 |
| Chlorinated Trisodium Phosphate | 17.3 |
| Tetrasodium Pyrophosphate | 6.1 |
| LAS ($C_{12}$ benzene sulfonate) | 2.2 |
| Minors (dye, perfume, etc.) | 0.5 |
| Water | 3.9 |
| The resultant composition is: Final Composition C | |
| Calcium Carbonate | 56.0 |
| Chlorinated Trisodium Phosphate | 13.8 |
| Benzyl Alcohol | 10.0 |
| Syloid Silica 244FP | 10.0 |
| Tetrasodium Pyrophosphate | 4.9 |
| LAS ($C_{12}$ benzene sulfonate) | 1.8 |
| Minors (dye, perfume, etc.) | 0.4 |
| Water | 3.1 |

*Syloid Silica 244FP is a fumed silica sold by W. R. Grace, having a particle size from about 0.002 mm to about 0.003 mm.

Composition A is prepared by mixing the benzyl alcohol and Syloid silica in a tumbler for a few minutes and using a spatula to break up lumps.

Composition B (a standard cleanser formulation) is prepared by combining the ingredients in a ribbon blender and blending for about 5 minutes.

Composition A is then mixed with Composition B as described above, followed by screening the product through a 65 mesh screen.

When this combined Composition C was tested for removal of soil, it was found to remove the soil with a scale rating of 93, while Composition B, by itself, had a rating of 10. Since this is a linear scale, the combined composition is 9 times better than Composition B itself.

An excellent bleach-free powdered cleanser can be made by substituting trisodium phosphate (TSP) for the chlorinated TSP in the above Composition C formulation.

What is claimed is:

1. A powdered free flowing abrasive cleanser comprising:

(a) 0.1% to 6% of a surfactant;

(b) 0.5% to 40% benzyl alcohol;

(c) 20% to 95% of a water-insoluble abrasive material having particle diameters ranging from about 0.3 to about 0.001 millimeters; and (d) 1% to 50% detergency builder; said percentages being percentages by weight, the sum of said (a), (b), (c) and (d) constituting at least 75% by weight of the total composition, the balance being water, inorganic salt and minor ingredients.

2. The powdered abrasive cleanser of claim 1 wherein said cleanser comprises from 0.5% to 3% benzyl alcohol.

3. The powdered abrasive cleanser of claim 1 wherein said cleanser contains from 3% to 40% benzyl alcohol and a carrier for the benzyl alcohol, wherein in the weight ratio of benzyl alcohol to carrier is from about 0.5:1 to about 10:1.

4. The powdered abrasive cleanser of claim 1 wherein said benzyl alcohol is microencapsulated and the ratio of benzyl alcohol to encapsulation carrier material is from 5:1 to 20:1 on a weight basis.

5. The powdered abrasive cleanser of claim 1 wherein benzyl alcohol comprises 3% to 12% of said cleanser.

6. The powdered abrasive cleanser of claim 1 wherein the surfactant is anionic.

7. The powdered abrasive cleanser of claim 1 wherein said cleanser comprises:

(a) 1% to 4% of sodium alkyl ($C_8$–$C_{18}$) benzene sulfonate (LAS) surfactant;

(b) 3% to 12% benzyl alcohol;

(c) 60% to 80% of calcium carbonate abrasive material; and (d) level of tetrasodium pyrophosphate builder at 1% to 20%.

8. A powdered free flowing abrasive cleanser comprising:

(a) 0.1% to 6% of a surfactant;

(b) 0.5% to 40% benzyl alcohol;

(c) 20% to 95% of a water-insoluble abrasive material having particle diameters ranging from about 0.3 to about 0.001 millimeters;

(d) 1% to 50% detergency builder; and (e) 0.1% to 5% of bleach active; said percentages being percentages by weight, the sum of said (a), (b), (c), (d) and (e) constituting at least 75% by weight of the total composition, the balance being water, inorganic salt and minor ingredients.

9. The powdered abrasive cleanser of claim 8 wherein said bleach is chlorinated trisodium phosphate.

10. The powdered abrasive cleanser of claim 8 wherein said benzyl alcohol is microencapsulated.

11. The powdered abrasive cleanser of claim 8 wherein said cleanser contains from 5% to 20% of said detergency builder.

12. The powdered abrasive free flowing cleanser of claim 8 wherein said benzyl alcohol is present at a level of from 0.5% to 3%.

13. A powdered free flowing abrasive cleanser comprising:

(a) 1% to 4% of a sodium alkyl ($C_1$–$C_8$) benzene sulfonate (LAS) surfactant;

(b) 0.5% to 3% benzyl alcohol;

(c) 60% to 80% of calcium carbonate abrasive material having particle diameters ranging from about 0.3 to about 0.001 millimeters; and (d) level of tetrasodium pyrophosphate builder at 1% to 20%; said percentages being percentages by weight, the sum of said (a), (b), (c) and (d) constituting at least 75% by weight of the total composition, the balance being water, inorganic salt and minor ingredients.

* * * * *